US005595517A

United States Patent [19]

Smith

[11] Patent Number: 5,595,517

[45] Date of Patent: Jan. 21, 1997

[54] SUPPORT FOR BOAT OARS

[76] Inventor: Stephen L. Smith, 133 James St., Mount Ephraim, N.J. 08059

[21] Appl. No.: 657,065

[22] Filed: May 29, 1996

[51] Int. Cl.[6] ..... B63H 16/06

[52] U.S. Cl. ..... 440/104; 114/343

[58] Field of Search ..... 440/101–110, 113; 114/343, 270

[56] References Cited

U.S. PATENT DOCUMENTS

| | | | |
|---|---|---|---|
| 2,033,637 | 3/1936 | Kaiser | 440/104 |
| 2,655,669 | 10/1953 | Schaper | 440/110 |
| 2,931,056 | 4/1960 | De Muro | 114/364 |
| 4,850,296 | 7/1989 | Slanker et al. | 114/343 |

*Primary Examiner*—Edwin L. Swinehart
*Attorney, Agent, or Firm*—Philip O. Post

[57] ABSTRACT

A support for boat oars to hold the oars in a fixed stationary and at rest position without the use of the rower's hands. The support is of particular use in a single sculling boat and consists of securing oar straps fastened to a bar. An overall riser rod assembly is formed by placing upper and lower riser rods on a connecting rod. The overall riser rod assembly is pivotally connected at one end to a plate attached to the bar and, at the other end, to a plate attached to a mounting bracket. The mounting bracket is fastened to the structure of the boat. The overall riser rod assembly can be adjusted in length to conform to various boats and rowers. The support is easily lowered to an out of the way location when not in use.

16 Claims, 3 Drawing Sheets

SUPPORT FOR BOAT OARS

BACKGROUND OF THE INVENTION

1. Technical Field

The invention relates to an attachment to a boat that allows the oars of the boat to be supported and held stationary in a fixed position.

2. Background Art

There is no simple and efficient device that allows the rower of a boat to maintain the oars in a stationary and at rest position. This position maintains the oars flat upon the water so that they will act as pontoons on the surface of the water. Such a device would be of assistance to the rower in entering or exiting a boat, and also for freeing the hands of the rower for other tasks while the rower is in the boat.

Small boats, and in particular, single sculling boats are very narrow in beam. Consequently, they can capsize very easily. Both oars must be properly held by the rower at all times to prevent the boat from capsizing. If the boat does capsize, it can be very difficult for the rower to reenter the boat.

Standard instructional methods for entering and exiting a sculling boat can be found in references such as *The Complete Recreational Rower and Racer* by S. Kiesling, 1990, Crown Publishers Inc., New York, N.Y. The method of boarding a sculling boat from a dock or in the water away from the dock is essentially the same. With respect to the oars, the oars must be in the oarlocks. A gate or keeper can be provided on the top of the oarlock to keep the oar in place. A button or collar, which is a ring around the sleeve of each oar, butts up against the inboard side of the oarlock. Both oar blades should be turned flat against the water or dock for maximum stability. The flat blades of the oars will act like pontoons on the surface of the water. The end of each oar is brought together so that the rower can grasp them with one hand. The other hand is used for balance as the rower steps into the boat. The function of holding the oars together can be accomplished by my invention, which eases the boarding of a boat, particularly by an inexperienced rower.

Similarly, exiting the sculling boat requires that the oars be held together with one hand. As stated above, the function of holding the oars together can be accomplished by my invention, which eases the exiting of a boat, particularly by an inexperienced rower.

For a boat that has capsized, the first task is to right it by reaching over the hull and grabbing the far rigger or gunwale. Once again, the oars must be arranged with the tips held together in one hand, while the rower swings his body back into the boat. With my invention, after the rower rights the boat, he or she can place the oars into the oar straps of my invention and have them held with the tips of the oars together and the oar blades flat against the water. This ensures that the oars are held in the proper position for reentering the boat, which allows the rower to focus on swinging his or her body back into the boat while grasping the oars.

While floating in the boat, the rower may insert the oars into the oar holding straps of my invention and perform other tasks, such as adjusting the footstretcher or reaching into the boat, without having to worry about maintaining the oars in the proper orientation.

The prior art discloses no device similar to my invention for holding the oars in a stationary and at rest position. Schaper in U.S. Pat. No. 2,655,669 discloses a device for strapping the rower's wrists to the oars in a manner that allows some control of the oars while the hands are free to perform other tasks. It is obvious from the disclosure that hand movements would be limited due to the direct connection of the hands to the oars. Also, the device does not address holding the oars fixed in a stationary and at rest position. Kaiser in U.S. Pat. No. 2,0333,637 discloses a complex device, complete with seat and footstretcher, that allows forward rowing and conversion from rowing to paddling. While the device can hold the oars in a horizontal position, as soon as the rower applies his weight to the oars, the oars drop into the water.

To address the limitations identified above, I took an approach that is considerably different from any in the prior art. In my invention, a simple and efficient device, is used to lock the oars in a stationary and at rest position. My invention provides a simple means of height adjustment so that the oars can be held in the proper stationary and at rest position for various types and designs of boats when used by rowers of varying sizes, weights and skill levels. Pivoting points at the bottom and top of the riser rod of my invention, and at the fasteners of the oar straps, allow for further adaptation to various types and design of boats when used by various rowers. It can be lowered away when not in use by pivoting the riser rod on the pivot point at the bottom of the riser rod. While I have specifically addressed the single sculling boat, my invention can be modified for applicability to other boats with oars.

SUMMARY OF THE INVENTION

Accordingly, it is a primary object of the present invention to provide a simple and efficient means of locking the oars of a boat in a stationary and at rest position. A mounting bracket, with a bracket plate fixed to it, is connected to the boat. A riser rod connects pivotally at one end to the bracket plate, and pivotally at the other end to a bar plate that is fixed to the strap mounting bar. A pair of oar straps are fastened pivotally to the strap mounting plate. Securing the oars in the oar straps allows the oars to be held in a stationary and at rest position without use of the hands. The pivot points at the bottom and top of the riser rod and at the fastening points of the oar straps allows for adjustment of my invention to various types and design of boats when used by rowers of varying sizes, weights and skill levels. Making the riser rod adjustable in length further allows for the accommodation of various types and design of boats when used by various rowers.

It is a further object of the present invention to provide a simple and adjustable riser rod in another embodiment of the present invention. In place of a single riser rod, as described above, an upper and lower riser rod are connected together by a connecting rod with threads at both ends. Screwing or unscrewing the connecting rod into or out of the lower and upper riser rods increases or decreases the overall length of the lower riser rod, connecting rod and upper riser rod combination. When a satisfactory length is achieved, the connecting rod can be locked into position relative to the upper and lower riser rods with appropriate locking fasteners.

Additional objects, advantages and other useful features of the invention will become apparent to those skilled in this art from the following description, wherein I have shown and described a preferred embodiment of this invention, simply by way of illustration of one of the modes best suited to carrying out the invention. As will be realized, the invention is capable of other and different embodiments, and its several details are capable of modifications in various, obvious aspects, all without departing from the invention. Accordingly, the description is to be regarded as illustrative in nature, and not restrictive. The objects and advantages of the invention may be realized and attained by means of the instrumentalities and combinations particularly pointed out and claimed in the appended claims.

BEST MODE FOR CARRYING OUT THE INVENTION

Attachment to the Boat

Figure 3A:
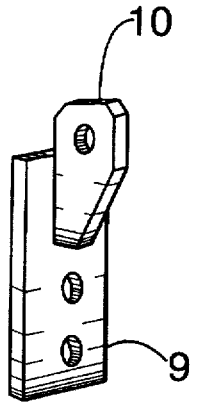
FIG. 3A is a perspective view of an alternate mounting bracket and bracket plate.
Figure 3C:
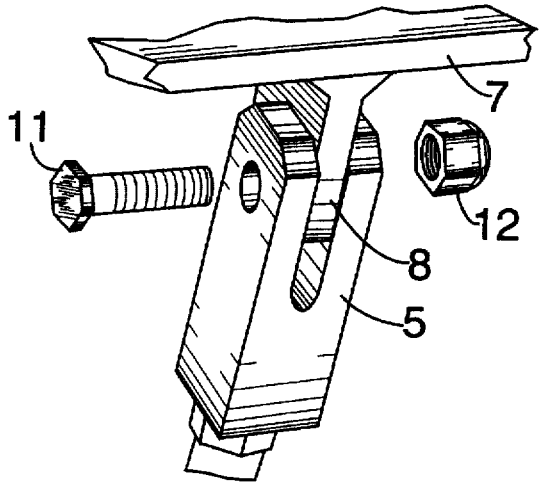
FIG. 3C is a partial perspective of the preferred embodiment showing the attachment of an upper riser rod to the bar plate of the strap mounting bar.
Figure 3B:
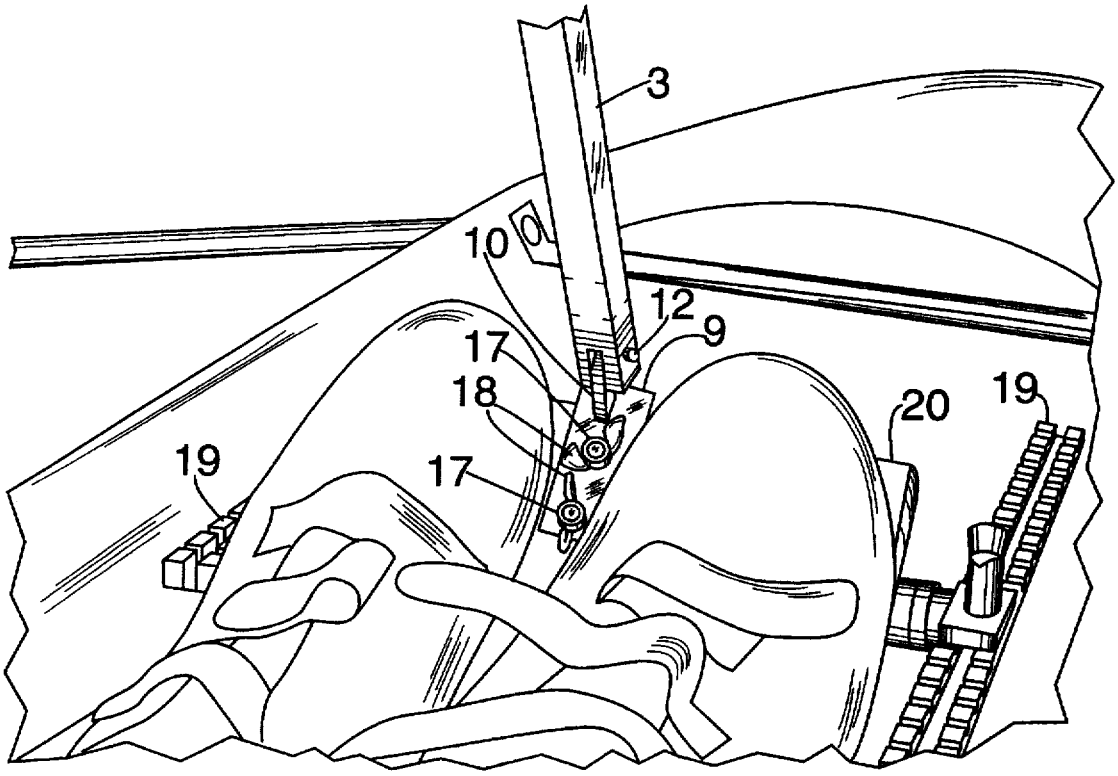
FIG. 3B is a partial perspective view of the preferred embodiment attached to a boat's footstretcher with an alternate mounting bracket and bracket plate.

As shown in the drawings, a mounting bracket 1 is fastened to a boat 21. A convenient attachment point to the boat 21 for the mounting bracket 1 is a footstretcher's adjusting tracks 19. The mounting bracket 1 can be connected to the footstretcher's adjusting tracks 19 by suitable fasteners, such as bolts 17 and wing nuts 18 through holes in the mounting bracket 1 and the footstretcher's adjusting tracks 19. The footstretcher 20 is a part of the internal structure of a boat. It consists of a crossmember running from port to starboard between which two shoes or clogs are fastened and into which the rower puts his or her feet. The footstretcher's adjusting tracks 19 are a pair of open rails that are a part of the internal structure of a boat on which the footstretcher 20 can slide fore and aft and through which fasteners attached to the footstretcher can be secured to adjust the position of the footstretcher for a particular rower. Optionally, an alternative mounting bracket 9 may be fastened to the footstretcher 20 as shown in FIG. 3B. The alternative mounting bracket 9 can be connected to the footstretcher 20 by suitable fasteners, such as bolts 17 and wing nuts 18 through holes in the alternative mounting bracket 9 and the footstretcher. While I show as the preferred methods of fastening the mounting bracket 1 to the footstretcher's adjusting tracks 19, or the alternative mounting bracket 9 to the footstretcher 20, it will be understood by those skilled in the art that my invention may be fastened to other structure of a boat without changing the utility of my invention. For example, in a boat where the riggers are attached to the gunwales of the boat aft of the footstretcher in the vicinity of a supporting crossmember of the boat, my invention may be suitably connected to the boat's crossmember.

Adjustable Riser Rod

The mounting bracket 1 has a bracket plate 2 rigidly attached to it. The bracket plate 2 is centered along the length of and perpendicular to the surfaces of the mounting bracket 1. Similarly, alternative mounting bracket 9 has an alternative bracket plate 10 rigidly fastened to it. The alternative bracket plate 10 is centered along the width of and perpendicular to the surface of the alternative mounting bracket 9. A hole in the bracket plate 2 and in alternative bracket plate 10 allows for the connection of a lower riser rod 3 to the bracket plate 2 or alternative bracket plate 10. The lower riser rod 3 is shown in the drawings as a rectangular rod with a forked end having holes and a tapped thread in the other end. The lower riser rod 3 is connected pivotally to either bracket plate 2 or alternative bracket plate 10 by placing the forked end of the lower riser rod 3 over either bracket plate 2 or alternative bracket plate 10 and placing a fastener through the holes in the forked end of the lower riser rod 3 and either bracket plate 2 or alternative bracket plate 10. Bolt 11 and dome nut 12 are suitable fasteners for securing the lower riser rod 3 to bracket plate 2 or alternative bracket plate 10. In the preferred embodiment, the method of fastening the lower rise rod 3 to either bracket plate 2 or alternative bracket plate 10 should be sufficiently loose so that the lower riser rod 3 can rotate freely about the pivot of the fastener. As shown FIG. 1, connecting rod 4 is an allthread rod. Alternatively, the connecting rod 4 may have a threaded length at each end sufficient to provide the required degree of length adjustment by screwing into or out of the lower riser rod 3 and an upper riser rod 5. The connecting rod 4 screws into the tapped threaded end of the lower riser rod 3. The upper riser rod 5 is similar to the lower riser rod 3 in that it is shown in the drawings as a rectangular rod with a forked end having holes and a tapped thread in the other end. The threaded end of the upper riser rod 5 screws into the connecting rod 4. Generally, the upper riser rod 5 will be shorter in length than the lower riser rod 3 to allow for convenient adjustment of the overall length of the lower riser rod 3, the connecting rod 4, and the upper riser rod 5, by screwing either the lower riser rod 3 or upper riser rod 5 into or out of the connecting rod 4. When the appropriate length for a specific boat and rower is achieved, lock nuts 13, or other suitable locking fasteners, on the connecting rod 4 can be secured against the lower riser rod 3 and the upper riser rod 5. While I have shown in the preferred embodiment rectangular upper and lower riser rods, it is understood that they may be made of other suitable shapes, such as circular rods. Furthermore, it is understood that if my invention is applied to a single boat design used by one rower, the lower riser rod 3, connecting rod 4 and the upper riser rod 5, may be combined into one riser rod since there would be no need for adjustments when the height of the pivoting riser rod is selected for a specific boat used by one rower. Similarly, the overall riser rod may consist of another type of adjustable riser rod, for example, an upper riser rod inserted into a lower riser rod, whereby the upper riser rod slides into or out of the lower riser rod to adjust the overall length. When the desired overall length is achieved, the riser rods may be locked into position with suitable fasteners.

Straps for the Oars and Strap Mounting Bar

Figure 1:
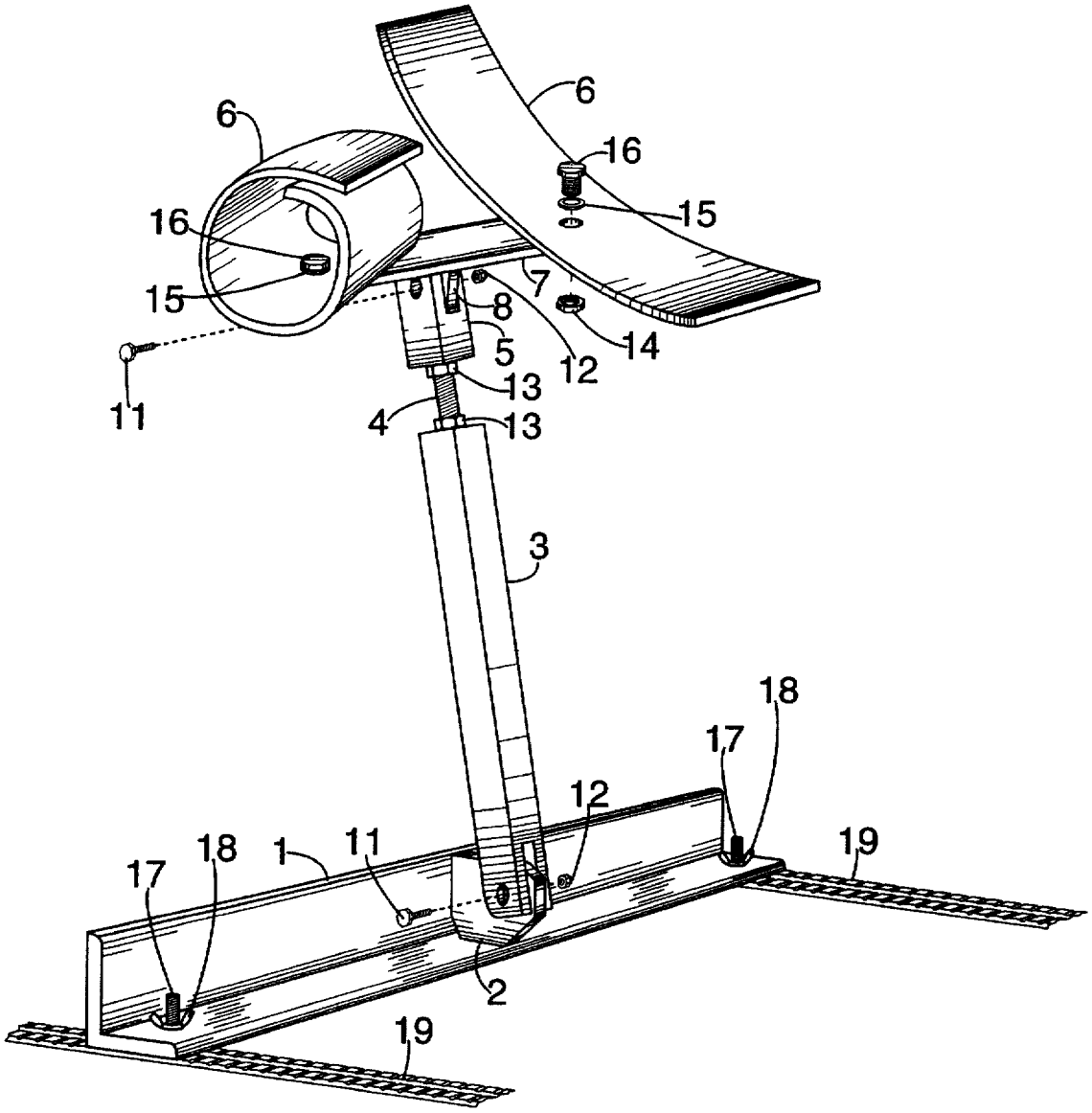
FIG. 1 is a perspective view of the preferred embodiment attached to the footstretcher adjusting tracks of a boat.
Figure 2:
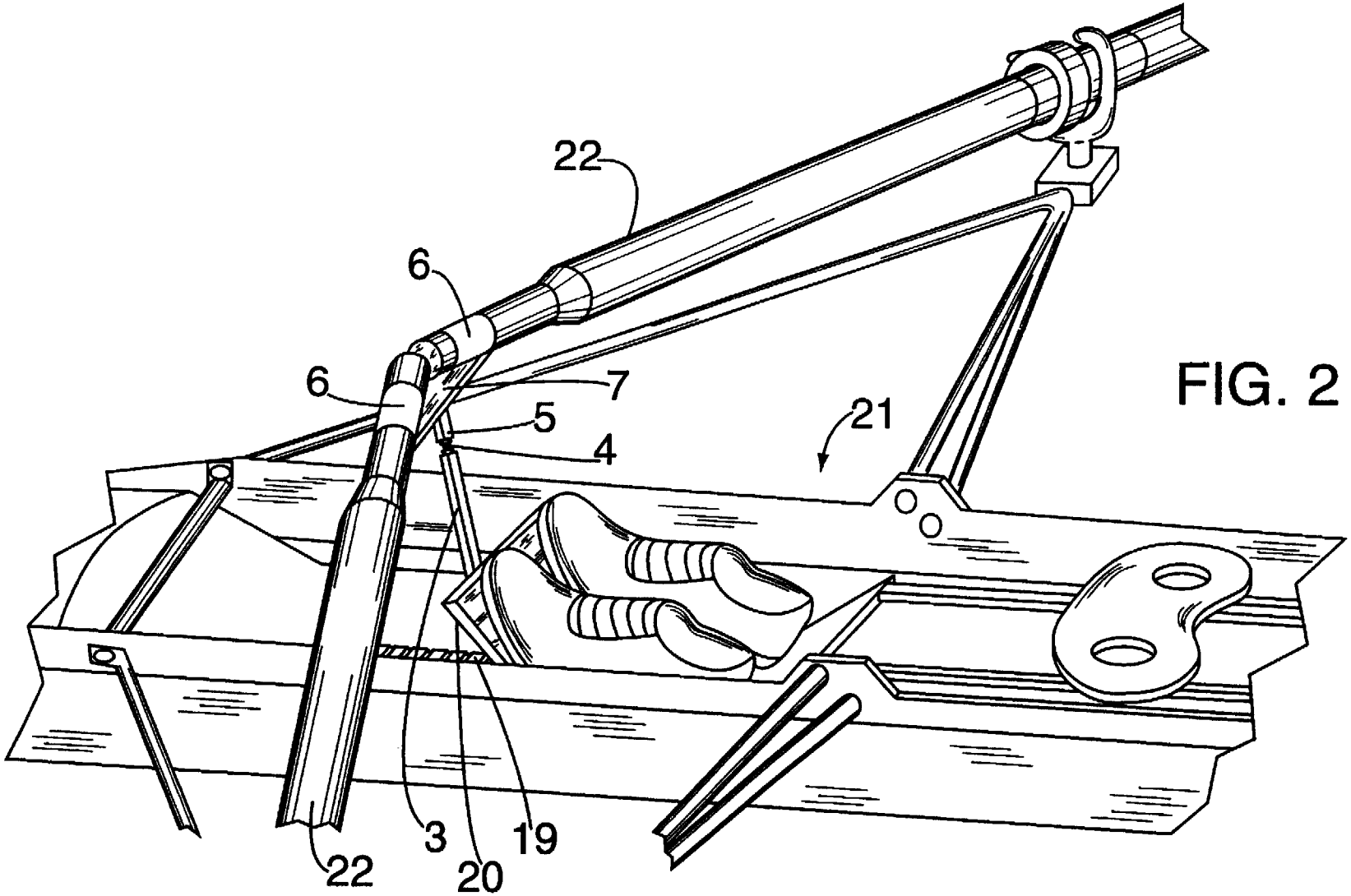
FIG. 2 is a perspective view of the preferred embodiment attached to a boat with the oars secured in the oar straps.

Straps 6 hold the oars 22 in place. In the preferred embodiment, the straps 6 are made of VELCRO. Each strap 6 is wrapped around an oar as shown in FIG. 2. The VELCRO surface of minute hooks fastens to the opposite VELCRO surface of uncut pile and locks each oar in place. The straps 6 may also be fabricated from other material, such as leather, with a buckle type of locking device. Each strap 6 is fastened to a strap mounting bar 7 as shown in FIG. 1. As shown in the drawings, the strap mounting bar 7 is a rectangular bar. Each strap 6 is connected by suitable fasteners to the strap mounting bar 7. In the preferred embodiment, as shown in FIG. 1, a flat-head bolt 16, flat washer 15 and dome nut 14 are used to fasten each strap 6 to the strap mounting bar 7. The straps 6 may also be riveted to the strap mounting bar 7. In the preferred embodiment, the fasteners should be sufficiently loose so that the straps 6 can freely rotate about the fasteners. The strap mounting bar 7 has a bar plate 8 rigidly attached to it. The bar plate 8 is located on the strap mounting bar 7 on the side opposite on which the straps 6 are fastened, and is centered along the length of and perpendicular to the surface of the strap mounting bar 7. A hole in the bar plate 8 allows for the connection of the upper riser rod 5. The upper riser rod 5 is connected pivotally to the bar plate 8 by placing the forked end of the upper riser rod 5 over the bar plate 8 and placing a fastener through the holes in the forked end of the upper riser rod 5 and bar plate 8. Bolt 11 and dome nut 12 are suitable fasteners for securing the upper riser rod 5 to bar plate 8. In the preferred embodiment, the method of fastening the upper riser rod 5 to the bar plate 8 should be sufficiently loose so that the upper riser rod 5 can rotate freely about the pivot of the fastener.

In using the preferred embodiment of my invention, the rower would fasten the mounting bracket 1 or alternative mounting bracket 9 to the boat 21. The rower would then assemble the lower riser rod 3, the connecting rod 4 and the upper riser rod 5 into one assembly by screwing the lower riser rod 3 and the upper riser rod 5 into the connecting rod 4. The forked end of lower riser rod 3 is then fastened to bracket plate 2 or alternative bracket plate 10 for mounting bracket 1 or alternative mounting bracket 9, respectively. The strap mounting bar 7, with straps 6 fastened to it, is attached to the forked end of the upper riser rod 5 by bar plate 8. Prior to placing the boat in the water, the rower can make preliminary adjustments to the overall length of the lower riser rod 3, the connecting rod 4, and the upper rod 5 to suit a particular boat design and the rower's size, weight and level of skill, by screwing either the lower riser rod 3 or upper riser rod 5 into or out of the connecting rod 4. When the correct length is achieved, that is, the length required to allow the oars to rest upon the surface of the water, locking nuts 13 on the connecting rod 4 are secured against the lower riser rod 3 and the upper riser rod 5. Any required final adjustments can be made in the water by the rower. My invention, the hands-free support for boat oars is ready for use by the rower. The rower simply needs to bring the tips of the oars 22 together in the proper orientation and secure each of them in an oar strap 6. When the hands-free support is not in use, it can be rotated down into the boat by pivoting the lower riser rod 3 around its fastener to bracket plate 2 or bracket plate 10.

In summary, I have discovered a simple and efficient device that is very adjustable and can be used in various types and design of boats when used by rowers of varying sizes, weights and skill levels to hold the oars in a stationary and at rest position without the use of the rower's hands.

I claim:

1. A device for supporting the oars of a boat in a fixed position comprising:

a mounting bracket connectable to the boat;

a bracket plate fixed to the mounting bracket;

a riser rod, having two forked ends, which is connected pivotally by a fastener at one forked end to the bracket plate;

a bar plate which is connected pivotally by a fastener to the forked end of the riser rod opposite the end of the riser rod connected to the bracket plate;

a strap mounting bar which is fixed to the bar plate;

a pair of oar straps, which are connected by fasteners to the strap mounting plate, whereby the oars of the boat can be strapped and held in a fixed position.

2. The device of claim 1 wherein the riser rod is adjustable in length.

3. The device of claim 2 with means to lock the riser rod in an adjusted position.

4. The device of claim 1 wherein the mounting bracket is connectable to the boat's footstretcher's adjusting tracks.

5. The device of claim 1 wherein the mounting bracket is connectable to the boat's footstretcher.

6. The device of claim 1 wherein the mounting bracket is connectable to a crossmember of the boat.

7. The device of claim 1 wherein the pair of oar straps are hook and pile fastener material.

8. The device of claim 1 wherein the oar straps are connected by fasteners to the strap mounting plate which allow the oar straps to pivot around the fasteners.

9. A device for supporting the oars of a boat in a fixed position comprising:

a mounting bracket connectable to the boat;

a bracket plate fixed to the mounting bracket;

a lower riser rod, having a forked end and a tapped thread at the other end, which is connected pivotally by a fastener at the forked end to the bracket plate;

a connecting rod, having screw threads at each end, which is connected to the lower riser rod by screwing the connecting rod partially into the end of the lower riser rod with a tapped thread, so that the overall length of the lower riser rod and connecting rod can be changed by screwing the connecting rod further into or out of the end of the lower riser;

an upper riser rod, having a forked end and a tapped thread at the other end, which is connected to the connecting rod by screwing the end of the upper riser rod partially onto the end of the connecting rod which is opposite the end on which the lower riser rod is connected to, so that the overall length of the lower riser rod, connecting rod and upper riser rod can be changed by screwing the upper riser rod further onto or off of the connecting rod;

means for locking the connecting rod in a fixed position relative to the lower riser rod and the upper riser rod, so that the selected overall length of the lower riser rod, connecting rod and upper connecting rod can be fixed;

a bar plate which is connected pivotally by a fastener to the forked end of the upper riser rod;

a strap mounting bar which is fixed to the bar plate;

a pair of oar straps which are connected by fasteners to the strap mounting plate, whereby the oars of the boat can be strapped and held in a fixed position.

10. The device of claim 9 wherein the mounting bracket is connectable to the boat's footstretcher's adjusting tracks.

11. The device of claim 9 wherein the mounting bracket is connectable to the boat's footstretcher.

12. The device of claim 9 wherein the mounting bracket is connectable to a crossmember of the boat.

13. The device of claim 9 wherein the pair of oar straps are hook and pile fastener material.

14. The device of claim 9 wherein the connecting rod is allthread.

15. The device of claim 9 wherein the upper riser rod is shorter in length than the lower riser bar.

16. The device of claim 9 wherein the oar straps are connected by fasteners to the strap mounting plate which allow the oar straps to pivot around the fasteners.

* * * * *